US006164025A

United States Patent [19]

Lindgren

[11] Patent Number: 6,164,025

[45] Date of Patent: Dec. 26, 2000

[54] WINDOW HAVING AN IMPROVED WINDOW FRAME STRUCTURE

[75] Inventor: Claes Lindgren, Farum, Denmark

[73] Assignee: Velux Industri A/S, Søborg, Denmark

[21] Appl. No.: 09/297,046

[22] PCT Filed: Nov. 13, 1997

[86] PCT No.: PCT/DK97/00516

§ 371 Date: Apr. 28, 1999

§ 102(e) Date: Apr. 28, 1999

[87] PCT Pub. No.: WO98/22681

PCT Pub. Date: May 28, 1998

[30] Foreign Application Priority Data

Nov. 19, 1996 [DK] Denmark ..... 1316/96

[51] Int. Cl.[7] ..... E06B 1/32; E04D 13/035

[52] U.S. Cl. ..... 52/200; 52/72

[58] Field of Search ..... 52/200, 72

[56] References Cited

U.S. PATENT DOCUMENTS

| | | | |
|---|---|---|---|
| 2,947,267 | 8/1960 | Stark | 52/72 X |
| 3,461,625 | 8/1969 | Sandow | 52/200 X |
| 3,473,276 | 10/1969 | Back et al. | 52/200 |
| 4,750,302 | 6/1988 | Bechtold | 52/200 X |
| 4,757,655 | 7/1988 | Jentoft et al. | 52/200 |
| 4,776,141 | 10/1988 | Powell . | |
| 4,986,039 | 1/1991 | Weisner | 52/200 X |
| 5,103,603 | 4/1992 | Verby et al. | 52/200 X |
| 5,148,643 | 9/1992 | Sampson et al. | 52/200 |
| 5,669,186 | 9/1997 | Verby et al. | 52/72 |

FOREIGN PATENT DOCUMENTS

| | | |
|---|---|---|
| 74858 | 10/1952 | Denmark . |
| 169232 | 11/1959 | Sweden . |
| 476195 | 9/1969 | Switzerland . |
| 592236 | 10/1977 | Switzerland . |
| WO/95/05519 | 2/1995 | WIPO . |

*Primary Examiner*—Laura A. Callo
*Attorney, Agent, or Firm*—Venable; John P. Shannon

[57] ABSTRACT

The window comprises a frame structure and relative to the frame structure an openable, top-hung sash structure with an insulating pane (4) enchased between top, bottom and side members (5–7) of metal or plastic profiles. The insulating pane (4) is manufactured with dimensions corresponding to the exterior dimensions of the frame structure for direct abutment on a gasket (11–13) fastened to the exterior edge surfaces (17–19) of the top, bottom and side members of the frame structure, and the top, bottom and side members of the frame structure are made from a thermally well insulating material and on the interior side facing the light admitting area of the window covered by metal sheet profiles (31) for providing a good heat transmission to border areas of the insulating pane (4). The frame structure may consist of wood profiles (23) connected in profiled mitre joints (24).

10 Claims, 5 Drawing Sheets

WINDOW HAVING AN IMPROVED WINDOW FRAME STRUCTURE

Figure 1:
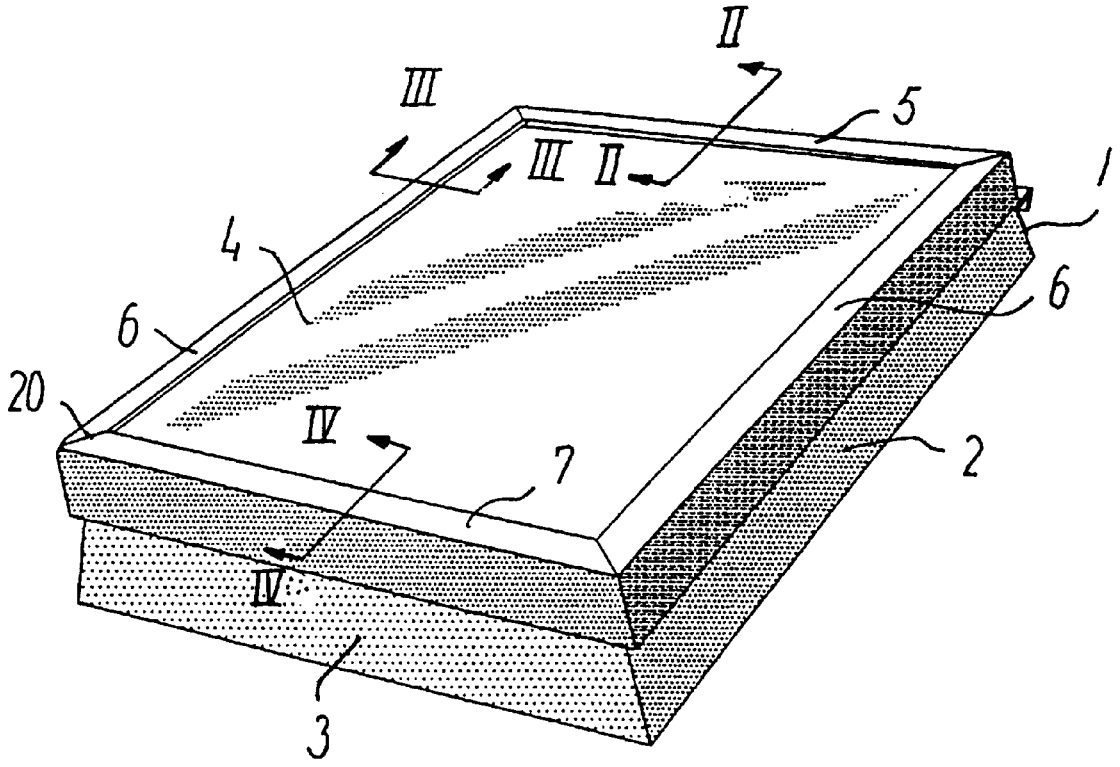

The present invention relates to a window, in particular for mounting in an inclined roof surface, comprising a frame structure with top, bottom and side members and a relative to the frame structure openable, top-hung sash structure with an insulating pane enchased between top, bottom and side members of metal or plastic profiles and manufactured with dimensions corresponding to the exterior dimensions of the frame structure for direct abutment on a gasket fastened to the exterior edge surfaces of the top, bottom and side members of the frame structure.

In respect of windows of this type, which are i.a. known from DK patent no. 74,858, it is a general problem to obtain sufficient tightness and insulation relative to the room inside, in particular if for reasons of appearance, when the windows are for instance to be used in protected buildings, traditional building materials cannot be used.

Windows of this simple design are thus first and foremost suited for more or less uninhabited areas, for instance ceilings or outhouses. In living-quarters condensation will, however, easily form on the interior side of the insulating pane, when the cold outside air gets in contact with the hot and humid indoor air. Condensation is a well-known problem within this field and has been solved in many in themselves satisfactory, but expensive and complicated ways.

The object of the invention is to provide a window of the type mentioned by way of introduction, which is both easy and inexpensive to manufacture, but which at the same time meets the demands in respect of insulating properties and of avoiding condensation, which are made to a window to be used in occupied areas.

This object is met according to the invention by a window which is characterized in that the top, bottom and side members of the frame structure are made from a thermally well insulating material and on the interior side facing the light admitting area of the window covered by metal sheet profiles for providing a good heat transmission to border areas of the insulating pane.

By making the sealing between the sash and the frame in this way, instead of the traditional way of placing a weather strip in a groove in the frame or the sash, the demands made on the manufacture of the sash are smaller and the formation of thermal bridges is avoided. In combination with the well-insulated frame and the heat transmitting profiles, such a window will under normal conditions be substantially free of condensation.

The top, bottom and side members of the frame structure preferably comprise wood profiles connected in profiled mitre joints, which, in addition to making the mounting of the window frame structure simple, gives a further improved insulation, the badly insulating end faces of the wood profiles being covered.

In a material-saving embodiment the wood profiles have substantially parallelogram-shaped cross-section, said exterior edge surfaces being positioned in a common plane, with which the adjacent opposite side faces of the profile cross-section form an angle of 95 to 140°.

A preferred embodiment of the invention is characterized in that the thickness of the wood profiles is comparatively small and that for improving the heat insulating properties additional insulating elements of a good heat-insulating material area are retained to the side of the profile cross-section which is intended to form the interior side for the top, bottom and side members of the frame structure.

In an embodiment which has been developed with a particular view to reusing the material of the window, the wood profiles in the top, bottom and side members of the frame structure are releasably connected with said heat-transmitting metal sheet profiles and additional insulating elements, if any, whereby the window, when dismounted, will be easy to disassemble.

Further embodiments of the invention will appear from the remaining independent claims, which have not been mentioned above.

Figure 2:
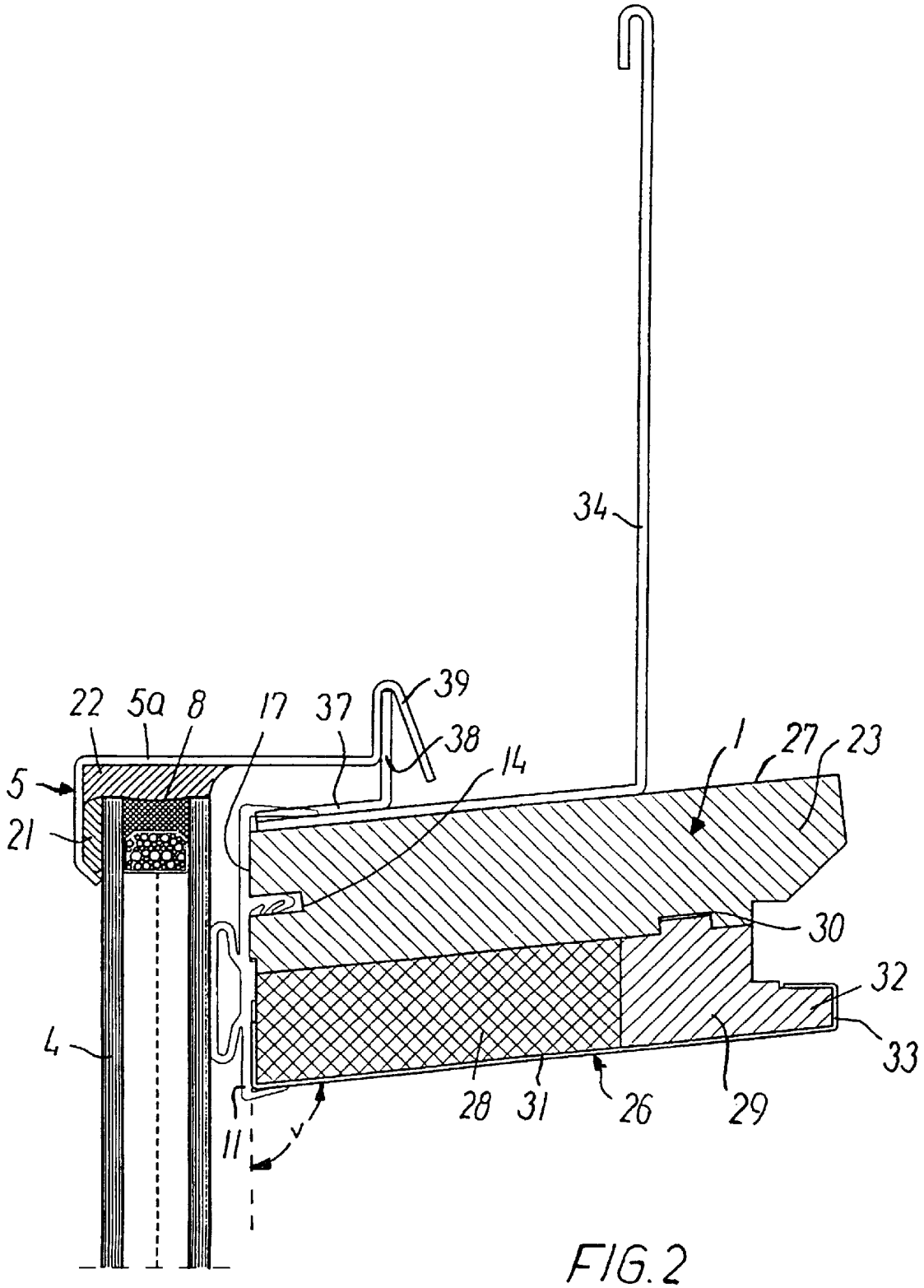
Figure 3:
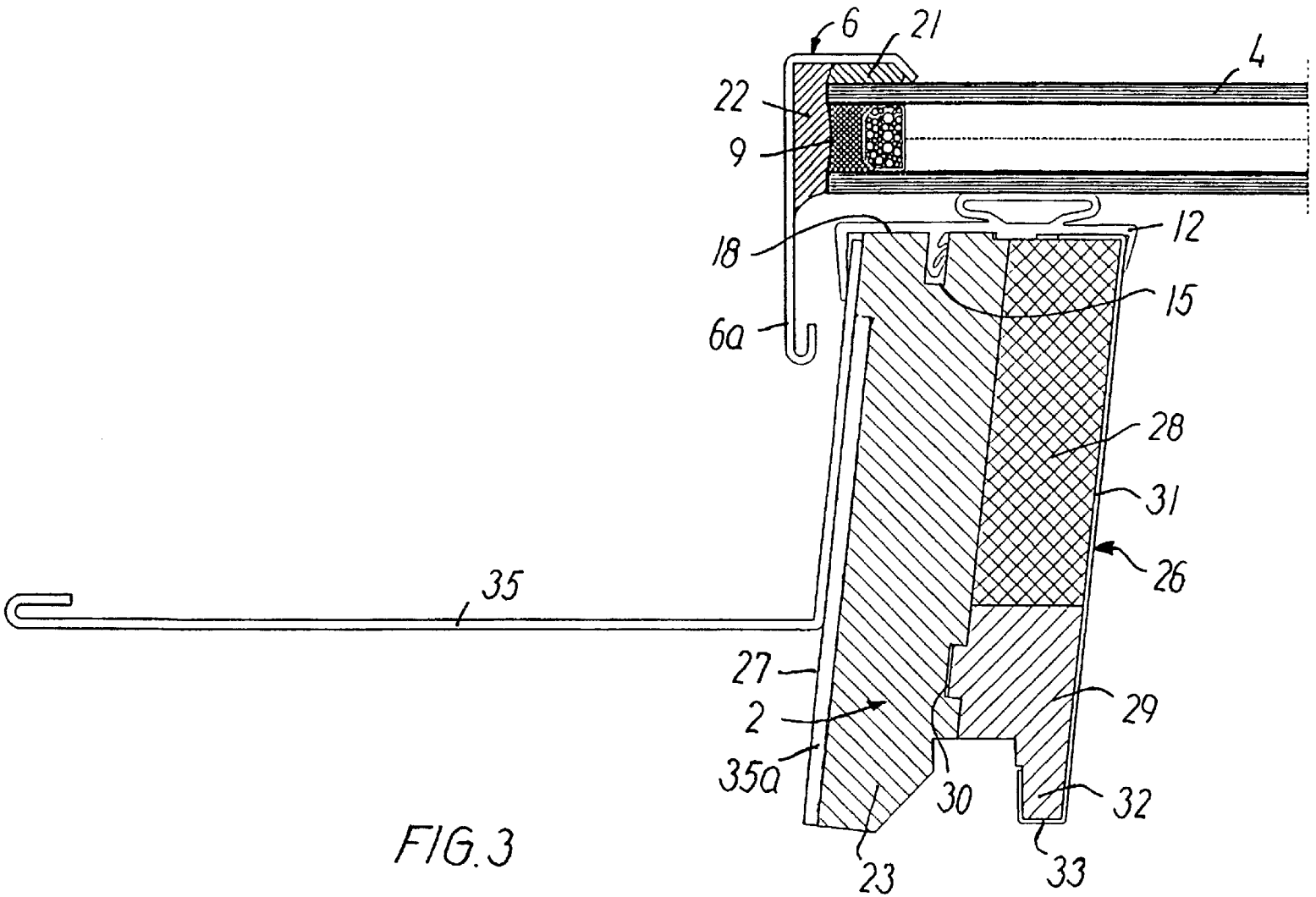
Figure 4:
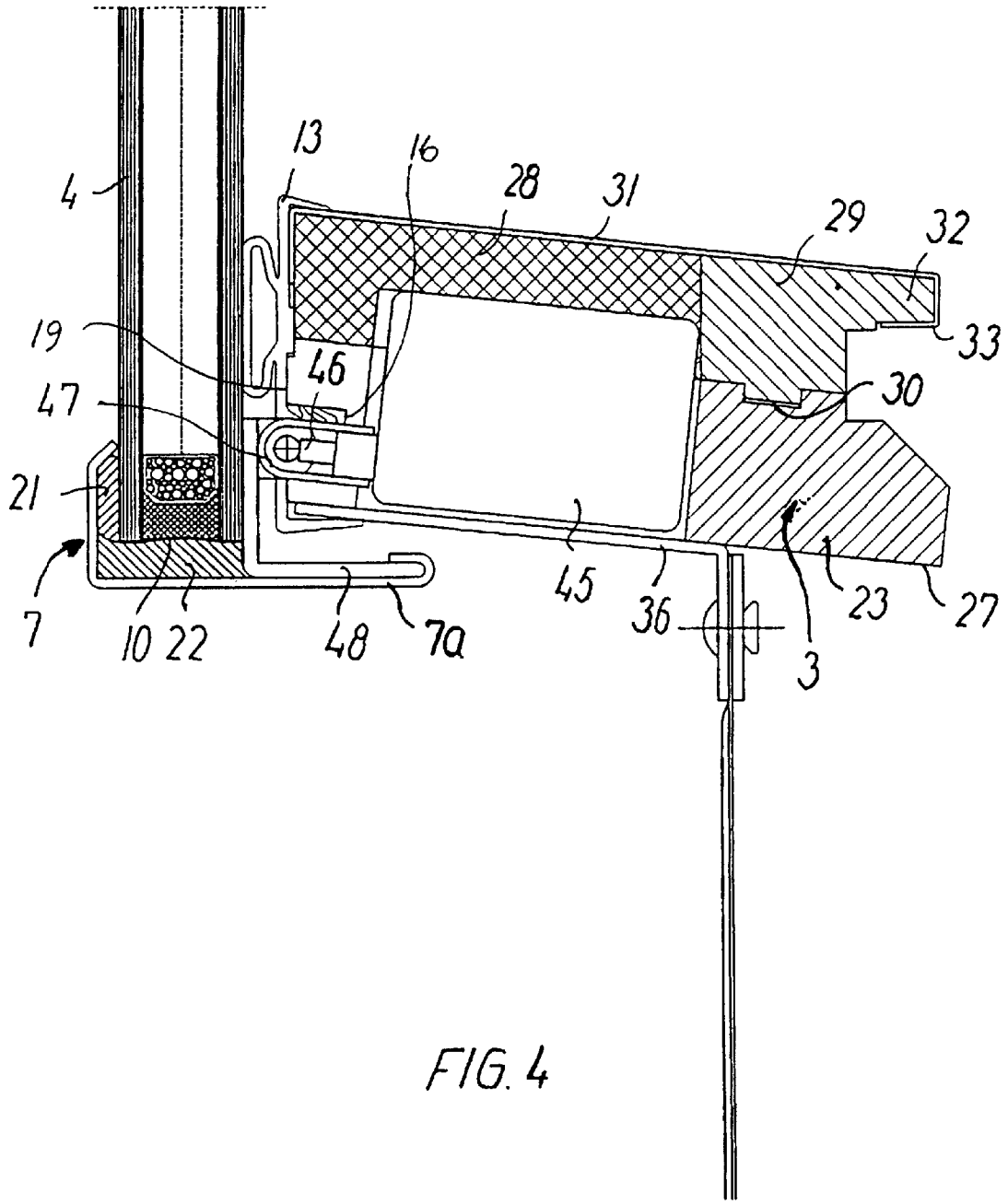
Figure 5:
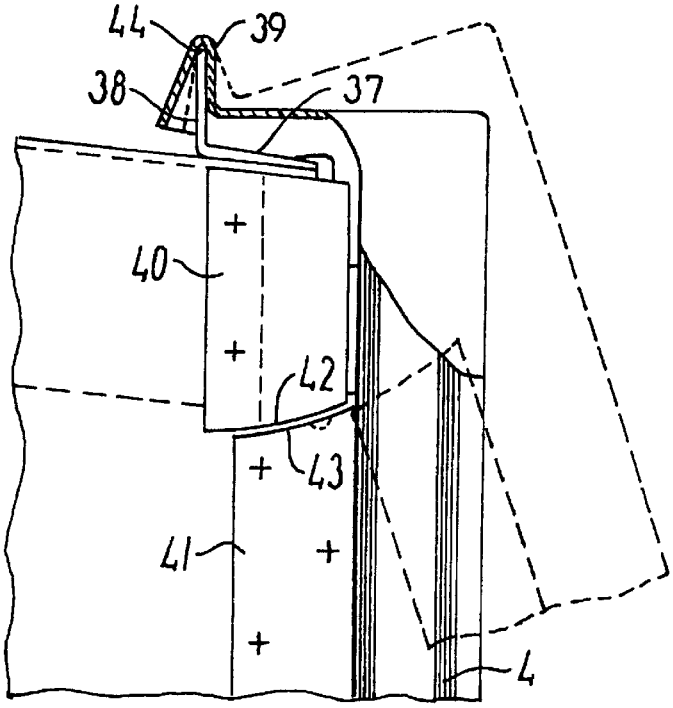

The invention will be explained in the following with reference to an embodiment as shown in the accompanying drawing, in which FIG. 1 is a perspective view of a top-hung window to be mounted in an inclined roof surface, FIGS. 2, 3 and 4 show a cross-section of the top, side and bottom members of the frame and sash structures along the lines II—II, III—III and IV—IV in FIG. 1, FIG. 5 shows the design of a top hinge for the window, a lateral and partially sectional view of the sash, and FIG. 6 the design of corner joints between the top, side and bottom members of the frame structure.

In the embodiment shown in the drawings, a top-hung roof or skylight window according to the invention comprises a frame structure having a top member 1, side members 2 and a bottom member 3 and a top-hung sash structure openable relative thereto, in which an insulating pane 4 is enchased between a top member 5, side members 6 and a bottom member 7.

As will appear from the cross-sectional views in FIGS. 2–4, the insulating pane 4 is manufactured with dimensions which substantially correspond to the exterior measures of the frame structure, such that the edge surfaces 8–10 of the pane 4 are substantially flush with the exterior sides of the top, side and bottom members 1–3 of the frame structure, and such that the insulating pane 4 in the closed position of the window directly abuts resilient sealing profiles 11–13, which are retained in grooves 14–16 in exterior edge surfaces 17–19 of the top, side and bottom members 1–3 of the frame structure.

The sash profiles 5–7 are in the embodiment shown designed as metal sheet profiles with substantially L-shaped cross-section with a small wall thickness and mutually connected by corner joints 20, which, as shown in FIG. 1, may be made as 45° angular joints.

In this very simple and light sash structure, the insulating pane 4 is secured by an adhesive sealing, for instance, as shown, by joints 21 and 22 of silicone adhesive.

The wall 5*a*–7*a* of the L-shaped cross-section of the sash profiles 5–7, which abuts the edge surfaces 8–10 of the insulating pane 4, is, as shown, manufactured with such a width that in the closed position it overlaps the exterior side of the frame member 1–3 lying behind it and is at its interior edge folded for providing a softly rounded edge.

Figure 6:
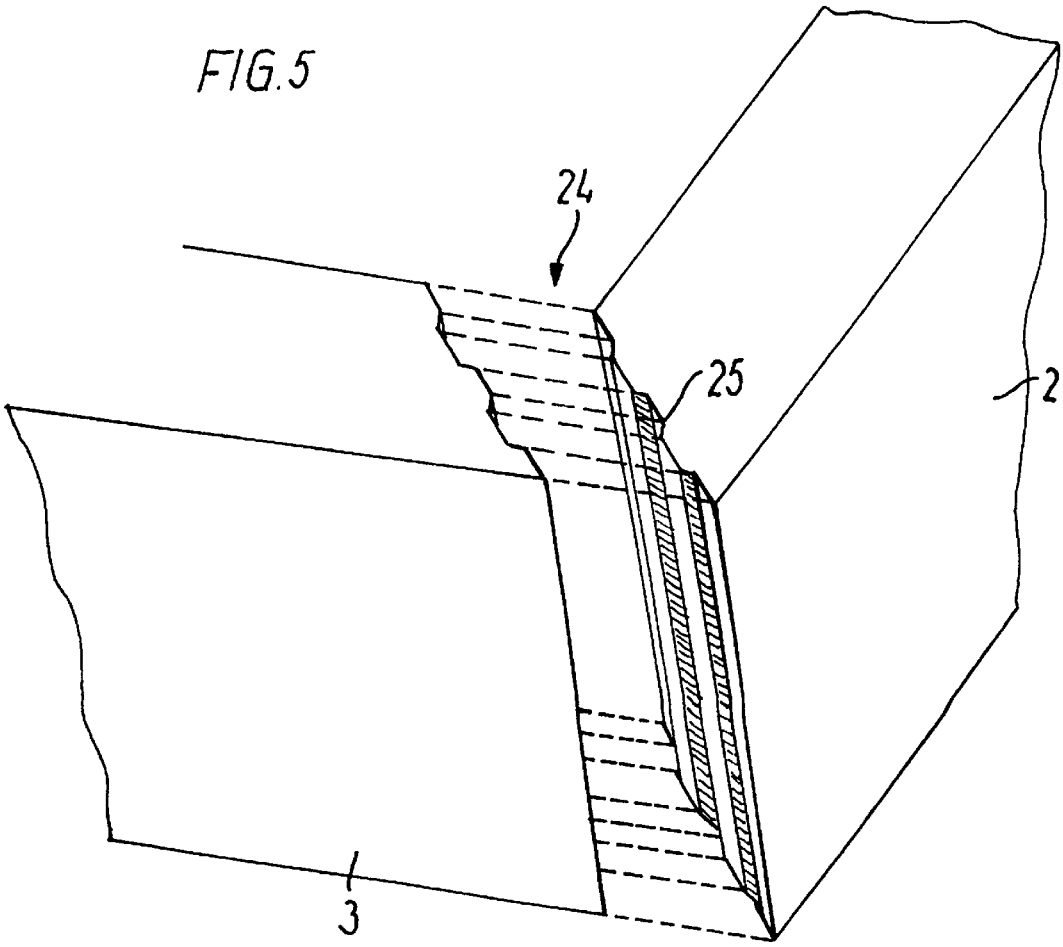

With a view to obtaining a good thermal insulation, the top, side and bottom members 1–3 of the frame are made from wood profiles 23, which, as shown in FIG. 6, are connected at the corners in profiled mitre joints 24, for instance with undulating abutment surfaces 25. This method of joining has the advantage that it partly provides a safe mutual locking of the top, side and bottom members 1–3, partly gives optimum insulation properties, the end surfaces of the wood profiles being removed from the exterior sides of the frame members.

In the embodiment shown, the frame wood profiles 23 are manufactured with a substantially parallelogram-shaped cross-section, in which the above-mentioned exterior edge surfaces 17–19 lie in a common plane, with which the adjacent opposite side surfaces 26, 27 of the profile cross-section form an angle v of for instance 95 to 140°, in the embodiment shown 96°. By this profile cross-section, which provides the structure with the shape of a low frustum of a pyramid, an advantageous possibility is obtained of manufacturing the frame structure with oblique interior sides, which is desirable with a view to mounting various forms of accessories like for instance roller blinds and insect nets, and with a minimum consumption of material, the profiles 23 being, as shown, manufactured with a comparatively small thickness.

In the embodiment shown, the thermal insulation property of the frame structures is improved by the fact that to the side of the profiles 23, which is intended for forming the interior side of the frame structure, additional, substantially rod-shaped insulating elements 28 are retained, which may be manufactured from a suitable, well insulating material.

As will be seen from FIGS. 2–4, the insulating elements 28 extend across a part of the width of the wood profiles 23 and are supported by abutment lists 29 connected with the wood profiles 23 by groove and tongue joints 30.

On the interior sides 26, the top, side and bottom members 1–3 of the frame structures end in a covering of metal sheet profiles 31, which covers the entire interior side and extends towards the edge area of the insulating pane 4. By this metal sheet covering such an improved heat transmission towards the insulating pane is obtained that in practice it has turned out to be possible to completely prevent condensation, something which otherwise frequently happens at the border areas of roof or skylight windows. The heat transmission typically has the effect that at a room temperature of 20° C. and an outdoor temperature of 0° C., a temperature of about 14° C. is obtained on the interior side of the insulating pane 4.

The fact that the abutment lists 29, as shown, are designed such that they at a distance from the wood profiles 23 form a nose portion 32, may be exploited for retaining the covering profile 31 by manufacturing it with a folded edge portion 33.

This design of the frame structure entails that the wood profiles 23 and the abutment lists 29 connected therewith may be releasably connected with the insulating elements 28 and the covering profiles 31, which can easily be exchanged for lacquering/change of colour or for mounting of fittings for accessories, and which entails a simple, and from an environmental point of view advantageous construction, which makes it possible at a subsequent dismounting to easily separate the frame structure into wood profiles, insulating elements and metal profiles with a view to reusing the materials to a high degree.

On the exterior sides the top, side and bottom members 1–3 of the frame structure are in a manner known per se covered by flashing profiles 34–36 of metal sheets.

For fastening of the window to the underlying roof structure grooves 35*a* have, as shown in FIG. 3, been provided in the frame side members 2 for receiving fixing angles or straps, which are subsequently secured to the roof structure.

The sash and frame constructions shown makes it in an advantageous manner possible to make the top hinge of the window integral with the top members 1 and 5 of the frame and sash structures, respectively.

For this purpose a fitting member 37 with a hinge pin forming member in the form of a projecting wall portion 38 may be connected with the flashing profile 34 for the frame top member 1, whereas a substantially V-shaped hook member 39 is made integral with the wall portion 5*a* of the L-shaped metal sheet profile for the sash top member 5, said hook member 39 being hinged on the upward wall portion 38 and having an opening angle in the range of 20 to 30°.

To hold the hook member 39 and the projecting wall portion 38 in mutual engagement and to make a turning of the sash structure to a ventilation position possible, securing means have, as shown in FIG. 5, been secured to adjacent pairs of side members 2 and 6 of the frame and sash structures, said securing means comprising, in the embodiment shown, holding means 40 and 41, for instance in the form of blocks of a wear-resistant plastic material, with part-cylindrical guide surfaces 42 and 43 with axis in the pivot axis of the hinge 44. Within an opening angle range, which is smaller than the opening angle of the V-shaped hook member 39, the holding means 40 and 41 will keep the hinge members 38 and 39 in mutual engagement, whereas they, when the sash structure is turned beyond this opening angle range to the position shown by a dotted line in FIG. 5, will be disengaged and thus allow an easy dismounting of the sash structure relative to the frame structure.

For opening the sash structure relative to the frame structure to a ventilation position within the opening angle range, a window operator may in a manner known per se be mounted in connection with the bottom members 3 and 7 of the frame and sash structures, for instance an electrically driven chain operator with an operator housing 45 accommodated in a recess in the wood profile 23 and the insulating element 28 and an operating chain 46, which may be detachably connected with a sash fitting 47 secured to a for instance L-shaped console 48 in connection with the L-shaped sash profile 7*a*, for instance secured to its folded edge portion.

What is claimed is:

1. A window, in particular for mounting in an inclined roof surface, comprising a frame structure with top, bottom and side members (1–3) made from a thermally insulating material and a relative to the frame structure openable, top-hung sash structure with an insulating pane (4) encased between top, bottom and side members (5–7) of metal or plastic profiles, characterized in that the pane is manufactured with dimensions corresponding to the exterior dimensions of the frame structure for direct abutment on a gasket (11–13) fastened to the exterior edge surfaces (17–19) of the top, bottom and side members of the frame structure, and that on the interior side facing the light admitting area of the window the top, bottom and side members of the frame structure are covered by metal sheet profiles (31) for providing heat transmission to border areas of the insulating pane (4).

2. A window according to claim 1, characterized in that the top, bottom and side members (1–3) of the frame structure comprise wood profiles (23) connected in profiled mitre joints (24).

3. A window according to claim 2, characterized in that said wood profiles (23) have substantially parallelogram-shaped cross-section, said exterior edge surfaces (17–19) being positioned in a common plane, with which the adjacent opposite side faces (26,27) of the profile cross-section form an angle (v) of 95 to 140°.

4. A window according to claim 3, characterized in that the thickness of the wood profiles (23) is reduced with respect to the thickness of said top, bottom and side members and that for improving the heat insulating properties additional insulating elements (28) of increased heat-insulating capability with respect to the wood profiles are retained to the side of the profile cross-section which is intended to form the interior side for the top, bottom and side members (1–3) of the frame structure.

5. A window according to claim 4, characterized in that the additional insulating elements (28) extend over a part of the width of the wood profiles (23) and are supported by abutment lists (29) of wood connected with the wood profiles.

6. A window according to claim 5, characterized in that said abutment lists (29) at the inwards facing edge side of the wood profiles (23) form a nose portion (32) for retaining a folded edge member (33) of the heat-transmitting metal sheet profiles (31), said nose portion being situated at a distance from the adjacent inner side of the wood profiles.

7. A window according to claim 2, characterized in that the wood profiles (23) in the top, bottom and side members of the frame structure are releasably connected with said heat-transmitting metal sheet profiles (31) and additional insulating elements (28), if any.

8. A window according to claim 2, characterized in that the outwards facing side faces of the top, bottom and side members (1–3) of the frame structure are covered by flashing profiles (34–36) of metal sheet.

9. A window according to claim 8, characterized in that a fitting member (37) is connected with the flashing profile (34) for the top member (1) of the frame structure, said fitting member having a projecting wall portion (38), which by engagement with a substantially V-shaped hook member (39) integral with the top member (5) of the sash structure forms a pivoting hinge for the sash structure relative to the frame structure.

10. A window according to claim 9, characterized in that holding means (40,41) are fastened to at least one adjacent pair of the side members (2,6) of the frame and sash structures, which holding means, within a predetermined opening angle range for the sash structure and calculated from the closed position, hold the V-shaped hook member (39) and said projecting wall portion (38) in mutual engagement, but which, when turning the sash structure beyond said opening angle range, allow removal of the sash structure from the frame structure.

* * * * *